US008580083B2

(12) United States Patent
Boechat et al.

(10) Patent No.: US 8,580,083 B2
(45) Date of Patent: Nov. 12, 2013

(54) DEVICE AND METHOD FOR PRODUCING A MATERIAL WEB

(71) Applicant: Voith Patent GmbH, Heidenheim (DE)

(72) Inventors: Joao V. Boechat, Sao Paulo (BR); Thomas Scherb, Sao Paulo (BR); Luiz C. Silva, Campo Limpo (BR); Rogerio Berardi, Sao Paulo (BR); Daniela Reis, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/749,182

(22) Filed: Jan. 24, 2013

(65) Prior Publication Data

US 2013/0133851 A1 May 30, 2013

Related U.S. Application Data

(60) Division of application No. 13/163,266, filed on Jun. 17, 2011, now Pat. No. 8,382,956, which is a continuation of application No. PCT/EP2009/065366, filed on Nov. 18, 2009.

(30) Foreign Application Priority Data

Dec. 19, 2008 (DE) ..... 10 2008 054 990

(51) Int. Cl.
*D21F 3/02* (2006.01)
*D21F 3/04* (2006.01)

(52) U.S. Cl.
USPC ..... 162/358.1; 162/358.2; 162/358.3; 162/360.2; 34/122

(58) Field of Classification Search
USPC ..... 162/358.1–358.4, 360.2, 361, 205, 900; 34/114, 116, 122–123
See application file for complete search history.

(56) References Cited

U.S. PATENT DOCUMENTS 3,796,149 A 3/1974 Heissenberger
3,906,853 A 9/1975 Wohlfarter
(Continued)

FOREIGN PATENT DOCUMENTS

DE 19946984 A1 5/2001
DE 102008054990 A1 6/2010
WO 2005075736 A2 8/2005

OTHER PUBLICATIONS

International Search Report for PCT/EP2009/065366 dated Feb. 12, 2011 (6 pages).
(Continued)

*Primary Examiner* — Jose A Fortuna
(74) *Attorney, Agent, or Firm* — Taylor IP, P.C.

(57) ABSTRACT

A method to dewater a fibrous web includes directing the fibrous web through a first press zone defined between a revolving permeable belt and a revolving permeable support belt and having a first press zone length. The fibrous web is arranged lying between the revolving permeable belt and the revolving permeable support belt. A fluid is caused to flow through the permeable belt, the fibrous web and the support belt at least over a section of the first press zone length. The fibrous web is dewatered in a second press zone following the first press zone and defined between the revolving permeable belt and the revolving permeable support belt, the second press zone having a second press zone length. The fibrous web is led through the second press zone between the permeable belt and the support belt, the permeable belt and the support belt each having a different compressibility.

11 Claims, 5 Drawing Sheets

(56) References Cited

U.S. PATENT DOCUMENTS

| | | | | |
|---|---|---|---|---|
| 5,393,384 | A | 2/1995 | Steiner et al. | |
| 7,291,249 | B2 | 11/2007 | Thoroe-Scherb et al. | |
| 7,476,294 | B2 * | 1/2009 | Herman et al. | 162/206 |
| 7,842,166 | B2 * | 11/2010 | Herman et al. | 162/358.3 |
| 8,382,956 | B2 * | 2/2013 | Boechat et al. | 162/358.1 |
| 2002/0117283 | A1 | 8/2002 | Soderholm et al. | |
| 2004/0149405 | A1 | 8/2004 | Beck | |
| 2004/0188049 | A1 | 9/2004 | Beck | |
| 2006/0086473 | A1 * | 4/2006 | Herman et al. | 162/358.2 |
| 2007/0029061 | A1 | 2/2007 | Scherb et al. | |
| 2007/0074835 | A1 | 4/2007 | Scherb et al. | |
| 2007/0256806 | A1 | 11/2007 | Scherb et al. | |
| 2008/0210397 | A1 * | 9/2008 | Scherb et al. | 162/205 |
| 2010/0170651 | A1 * | 7/2010 | Scherb et al. | 162/202 |
| 2011/0303379 | A1 | 12/2011 | Boechat et al. | |
| 2013/0133851 | A1 * | 5/2013 | Boechat et al. | 162/205 |

OTHER PUBLICATIONS

Derwent Abstract of DE 19946984 A1, Published on May 4, 2001.

* cited by examiner

Detail A

DEVICE AND METHOD FOR PRODUCING A MATERIAL WEB

CROSS REFERENCE TO RELATED APPLICATIONS

This is a division of U.S. patent application Ser. No. 13/163,266, noq U.S. Pat. No. 8,382,956, entitled "DEVICE AND METHOD FOR PRODUCTING A MATERIAL WEB", filed on Jun. 17, 2011, which is incorporated herein by reference. U.S. patent application Ser. No. 13/163,266 is a continuation of PCT Application No. PCT/EP2009/065366, entitled "DEVICE AND METHOD FOR PRODUCING A MATERIAL WEB", filed Nov. 18, 2009, which is incorporated herein by reference.

BACKGROUND OF THE INVENTION

1. Field of the Invention

The present invention relates to a device for dewatering a fibrous web, especially a tissue web. The present invention further relates to a method for dewatering a fibrous web and a machine to produce a fibrous web.

2. Description of the Related Art

Such devices for dewatering a fibrous web are known for the production of voluminous tissue products of high quality. This quality level is also referred to as "premium tissue". In qualities of this type, a voluminous sheet structure with good absorptive capacity and high water retention capacity is especially important. In producing premium tissue, quality is at the foreground. The production methods are very expensive and energy intensive. The costs of these tissue products are therefore very high.

Document WO2005/075736 A2 describes a machine and a method for the production of premium tissue. After the forming section the fibrous web is dewatered in a dewatering device with a belt press. For this purpose the fibrous web is arranged between a structured fabric and a belt, for example a felt, and is directed over a suction roll. The suction roll is operated with a high vacuum in order to gently dewater the web by means of the hot air flowing through it, whereby dewatering is supported by the belt press. For additional careful dry content increase, an air press or boost dryer is optionally arranged downstream. These devices are very expensive.

An additional possibility of producing premium tissue is offered by the known "through air drying" method (TAD). In this method, large volume flows of hot air or superheated steam are pressed through the fibrous web which is arranged on a structured fabric and directed over a large through-flow cylinder. An expensive air- or steam system is necessary. In the forming section a multitude of vacuum pumps with high energy requirement are additionally required.

In addition to the premium tissue, there is tissue of standard quality. This quality is produced on so-called Crescent tissue machines. These proven tissue machines are of very simple construction, use little energy and are designed for production. However, the quality of the produced fibrous web is clearly below that of premium tissue. This is true respectively also for the prices.

Both qualities are established in regional world markets. With the changes which have occurred over the last few years with regard to raw material and the increased cost of energy, the requirements of the market in regard to quality and prices of tissue papers have also changed. The markets increasingly demand new tissue qualities which, on the one hand are lower than the premium quality, however are clearly higher than the standard quality. The market technology, at the same time should require substantially less energy at lower consumption of high-grade raw materials for the production of the tissue papers.

What is needed on the art is a solution for cost-effective production of tissue papers of intermediate quality. In addition, the tissue machine for the production of tissue papers of intermediate quality is to be sufficiently flexible so that it is possible through rapid modification of the machine to produce premium qualities as well as standard and intermediate qualities.

SUMMARY OF THE INVENTION

The present invention provides a device for dewatering of a fibrous web, especially a tissue web, having a first press zone with a press zone length $L_1$, through which the fibrous web, which is arranged lying between a revolving permeable belt and a revolving permeable support belt, is directed. The first press zone is arranged so that a fluid can flow through the permeable belt, the fibrous web and the support belt, at least over a section of the press zone length $L_1$. The device further includes a second press zone having a press zone length $L_2$ following the first press zone. The fibrous web is carried through the second press zone between two belts having different compressibilities.

The device of the present invention provides the advantage that dewatering of the fibrous web in the second press nip is implemented gently and efficiently. Due to the different compressibility of the belts, it is ensured that in the second press nip, the fibrous web adapts to the surface structure of the belt with the lower compressibility while being pressed against it in the press nip by the belt with the higher compressibility. Because of this different compressibility or softness with the simultaneously present elastic behavior of the belt with higher compressibility, an intimate contact, uniform across the area is created between the fibrous web and the belts. This is ensured, for example, if a belt with a structured surface having pockets or indentations is utilized. This uniform contact favors dewatering, thereby achieving a higher dry content in the tissue web. The energy consumption of the entire production process can thereby be substantially reduced. A three-dimensional structure of the fibrous web and its surface is produced, or respectively maintained, with the device of the present invention while at the same time achieving a high dry content. This makes it possible to reduce the volume flow of the fluid flowing through the fibrous web in the first press nip and thereby reduce the energy consumption by approximately 25% compared to the premium quality.

Even though the quality compared to the premium quality is lower, it is still substantially better than the standard quality. Tests have shown that the thickness of the fibrous web is somewhat less than the premium quality, but is however still approximately 50% higher than standard tissue.

In a first embodiment of the device of the present invention, the belt with the higher compressibility which is directed through the second press zone is a felt. A suitable felt is, for example, a felt which is consistent with the so-called Vector technology of the applicant. A felt in accordance with this technology includes a woven base fabric onto which a non-woven layer consisting of felt fibers—a so-called Vector layer—is applied onto the side facing the fibrous web. The fibers of this layer are aligned three-dimensionally and have a count of greater than 30 decitex (dtex), for example greater than 67 dtex, or greater than 100 dtex. Or even greater than 140 dtex. This has the advantage that the felt is very open and therefore easily dewatered. The air permeability is less than 80 cubic feet per minute (cfm), for example less than 40 cfm, or less than 25 cfm.

Moreover, the three-dimensional arrangement of the coarse fibers in the Vector layer provide the felt with good resilience when running through the press nip. The felt is hereby compressed and springs back after the press nip, almost to its original thickness. The Vector layer may have a base weight in a range of 100 grams per meter square ($g/m^2$) to 500 $g/m^2$. The Vector layer may be covered by at least one structure of laid fibers consisting of finer fibers which comes into contact with the fibrous web. These finer fibers have a count of less than 30 dtex, less than 12 dtex, or less than 4 dtex.

In a second embodiment of the present invention an additional layer is provided between the at least one structure of laid fibers and the Vector layer whose fibers possess a count which is between the count of the fibers in the Vector layer and those in the laid fibrous structure which is in contact with the fibrous web. The count of the fibers in the additional layer is, for example, between 8 and 15 dtex, or 10 dtex.

In a third embodiment of the present invention, the belt with the lower compressibility which is directed through the second press zone is a belt having a structured surface and/or is a TAD-fabric. The belt with lower compressibility can include a woven structure and/or a nonwoven structure, for example a structured membrane.

The permeable belt of the first press nip may have a structured surface and/or be in the embodiment of a TAD-fabric. The permeable belt can include a woven structure and/or a non-woven structure, for example a structure membrane.

A structured belt in accordance with the present invention is configured so that the fibrous web itself receives a surface structure through the structure of the structured surface of the belt, thereby improving the quality of the tissue web.

According to a fourth embodiment of the present invention, the permeable belt of the first press nip provides the belt with the lower compressibility of the second press zone and is directed through same. This brings the advantage that the fibrous web can remain on the structured surface of the permeable belt and does not have to be transferred. This provides a high specific volume and the structure in the fibrous web.

The device for dewatering a fibrous web may be part of a tissue machine, whereby the permeable belt runs through the forming section of the tissue machine and the fibrous web is created and formed on this belt. The fibrous web remains advantageously on the permeable belt until the transfer to a drying cylinder to complete drying of the fibrous web. The transfer of the fibrous web occurs in a press zone which is formed by a press roll and a Yankee drying cylinder. For premium tissue the press roll is a smooth press roll without suction, and for an intermediate tissue quality it is a suction equipped suction press roll.

The device of the present invention can also be used in a twin wire former. In this type of former the fibrous web is transferred to a carrier belt after the forming section. The fibrous web is expediently transferred to the permeable belt.

The belt with the lower compressibility may have a coarser surface and/or a higher air permeability than the belt having the higher compressibility or greater softness.

In an additional embodiment of the present invention, the belt with the lower compressibility is a fine fabric with a thread density of the warp threads greater than 14.1 threads (Fd) per centimeter (cm) (36 threads/inch), equal or greater than 17.3 threads (Fd) per cm (44 threads/inch), or greater than 22 threads (Fd) per cm (56 threads/inch). This permits uniform close contact of the fibrous web with the fabric and the felt, thereby achieving a high dry content after the press.

The belt with the lower compressibility may have a finer fabric and the weft threads have a diameter of less than or equal to 0.45 millimeter (mm), less than or equal to 0.41 mm or less than or equal to 0.35 mm and the warp threads have a diameter of less than or equal to 0.40 mm, less than or equal to 0.35 mm, or less than or equal to 0.30 mm. The fabric thickness is in the range of 0.5 to 1 mm.

In a further embodiment of the present invention, the belt with the lower compressibility is a fine fabric having an air permeability greater than 14.16 cubic meters per minute ($m^3$/min) (500 cfm), greater than 15.58 $m^3$/min (550 cfm), or equal or greater than 17 $m^3$/min (600 cfm). This may be advantageous if the fine fabric runs through the first and the second press nip.

The belt with the lower compressibility may be a fine fabric, whereby at least the side contacting the paper has a contact area of equal or greater than 20%, equal or greater than 25%, or greater than 27%. This may be advantageous if the fibrous web is transferred directly from the fabric to the Yankee drying cylinder. At the areas of these contact points the fibrous web is pressed onto the surface of the drying cylinder. The stability of these press zones is hereby increased and thereby also the stability of the fibrous web. This allows use of cost-effective raw materials at constant stabilities. This contact area can be obtained by sanding or crimping of the fabric. With tissue webs of intermediate quality the contact area may be in a range of 20 to 32%.

In an additional embodiment of the present invention, the belt with the lower compressibility is a fine fabric with a structured surface. This has raised and indented zones, whereby the indented zones form pockets. The raised and indented zones are arranged uniformly on the fabric surface. Ornament structures can be superimposed.

The belt with the lower compressibility may be a fine fabric, whereby the surface portion of the raised zones of the paper-contact side is equal or greater than 20%, equal or greater than 25%, or equal or greater than 27%.

According to an additional embodiment of the present invention, the belt with the lower compressibility is a fine fabric with a structured surface of fewer than 77.4 pockets per centimeter square ($cm^2$) (500 pockets per $inch^2$), less than 38.7 pockets per $cm^2$ (250 pockets per $inch^2$), with equal or fewer than 31 pockets per $cm^2$ (200 pockets per $inch^2$), fewer than 28 pockets per $cm^2$ (180 pockets per $inch^2$), or less than 23 pockets per $cm^2$ (150 pockets per $inch^2$).

Depending upon the requirement, a belt with lower compressibility in the form of a fine fabric having a structured surface of more than 23 pockets per $cm^2$ (150 pockets per $inch^2$) or more than 69.7 pockets per $cm^2$ (450 pockets per $inch^2$) can be used. Applications are also possible in which very finely structured fabrics, having up to 154.8 pockets per $cm^2$ (1000 pockets per $inch^2$), are used.

For the production of toilet paper for example a fine fabric is used as belt, having a structured surface including up to 69.7 pockets per $cm^2$ (450 pockets per $inch^2$), or 55.7 pockets per $cm^2$ (360 pockets per $inch^2$). Depending upon the quality requirements the lower value of the number of pockets can be between 46.4 pockets per $cm^2$ (300 pockets per $inch^2$) and 3.87 pockets per $cm^2$ (25 pockets per $inch^2$).

In the production of fibrous webs for kitchen rolls a fine fabric with a structured surface is appropriately used as the belt with the lower compressibility, which has fewer than 40.3 pockets per $cm^2$ (260 pockets per $inch^2$) and more than 3.87 pockets per $cm^2$ (25 pockets per $inch^2$). For a greater water absorption capacity the number of pockets may be between 31 pockets per $cm^2$ (200 pockets per $inch^2$) and 23.2 pockets per $cm^2$ (150 pockets per $inch^2$).

In an additional embodiment of the present invention, the belt with the higher compressibility has a dynamic modulus for compressibility "G" of equal or higher than 0.5 Newton per square millimeter ($N/mm^2$), higher than 2 $N/mm^2$, or higher than 4 $N/mm^2$. In a practical case, the dynamic modulus for compressibility can be equal or higher than 0.05 $kN/mm^2$, higher than 1 $kN/mm^2$, or higher than 4 $kN/mm^2$. This dynamic modulus for compressibility "G" is a measure for the resilience or recovery properties of the belt.

The dynamic modulus for compressibility is consistent with the quotient from the pressure tension ($N/mm^2$) and the relative change in thickness (–) of the felt during compression. These values can be determined with the assistance of a measuring device. The measuring device, for example, has two plungers which are pressed against each other, each having a respective area A. The belt, or respectively felt sample is compressed between the plungers with a constant force F. The occurring change in thickness (delta D) is hereby measured by means of a position measuring system of a plunger. The dynamic modulus for compressibility is calculated from G=F/A/(delta D). With this measuring method the dynamic modulus for compressibility can be determined for the belt with the high, as well as for the belt with the low compressibility. The belt may be new or run in when measurements are taken.

Moreover, the belt with the higher compressibility may have a dynamic stiffness K* of less than 100000 Newton per millimeter (N/mm), less than 90000 N/mm or equal or less than 70000 N/mm. The dynamic stiffness K* (N/mm) is a measurement for the compressibility, whereby the compressibility provides the change in thickness of a belt in mm per force (N). The dynamic stiffness (K*) is calculated from the reciprocal value of the compressibility. The compressibility is hereby the quotient from the change in thickness (delta D) and the force, measured with the aforementioned measuring device.

In an embodiment of the present invention, the permeable support belt of the first press zone provides the belt having the higher compressibility of the second press zone and is directed through same. This embodiment provides stable web travel, good runability and a cost-effective solution.

In a further embodiment the permeable support belt does not have a structured surface and/or is in the embodiment of a felt.

In an additional embodiment of the present invention, the fluid which flows through the belt, the fibrous suspension, and at least in sections of the press zone length $L_1$ through the support belt is in the form of air and/or hot air and/or steam.

In accordance with another embodiment, press zone length $L_1$ is larger than press zone length $L_2$. Press zone length $L_1$ may be more than ten times as long as press zone length $L_2$, for example twenty times as long as press zone length $L_2$, or thirty as long as press zone length $L_2$. In one embodiment, the first press zone has, for example, a press zone length $L_1$ of 1200 mm.

In the first press nip gentle dewatering occurs at a low pressing power. A higher pressing power is applied in contrast in the second press nip. In addition to the technological advantages, this combination has the effect that the belt with the higher compressibility is cleaned by the higher, momentary press impulse. This is especially advantageous for a felt.

According to a further embodiment of the present invention, the first press zone is provided by a permeable press element and a permeable opposite element. The permeable press element may be in the embodiment of a press belt and/or a press shoe. The press belt consists of a belt having a tensile strength, for example a woven fabric, a spiral screen, a metal screen, a perforated metal belt or a belt consisting of a composite material. In order to produce the press pressure the press belt is tensioned with 40 kiloNewton per meter (kN/m) to 60 kN/m and is directed over the suction roll or the curved surface.

To provide the fluid a pressure hood is allocated to the press element in one embodiment of the present invention. The fluid can have overpressure or can be provided with ambient pressure. According to an additional embodiment the opposite element consists of a roll or a chest with curved or flat contact surface.

The opposite element in the first press zone may be suction equipped. For producing tissue webs of intermediate quality the vacuum applied to the opposite element is 0.4 to 0.3 bar and is thereby lower than for the production of premium tissue where the applied vacuum is in the range of 0.6 to 0.5 bar. This reduces the operating costs substantially. Here, the fluid in the pressure hood may be provided with no, or very little, overpressure. This avoids leakages.

In an additional embodiment of the present invention, the second press zone consists of a press element and an opposite element. The opposite element of the second press zone is, for example, in the embodiment of a smooth and/or hard roll. The surface of this roll is provided by a roll cover, whereby the thickness of the cover is approximately 15 mm. The surface has a hardness of 0 to 5 Pusey & Jones (P&J), or 0 to 1 P&J. In an additional embodiment the surface has grooves which are arranged progressing spirally or parallel in a circumferential direction.

An additional embodiment provides that the press element of the second press zone is a shoe roll, including a press shell and a press shoe.

In an additional embodiment of the present invention, the press element of the second press zone is a soft roll. The surface of the roll can have a hardness of 30 to 33 P&J. This roll also consists of a roll core with a roll cover. The thickness of the roll cover is in the range of 18 to 25 mm or 19 to 21 mm. The roll cover is selected so that—due to water absorption—the hardness becomes softer during operation of the roll by 4 to 5 P&J points.

In order to ensure good dewatering the press element has a blind bored and grooved surface. The grooves can be arranged progressing spirally or parallel in the circumferential direction.

In one embodiment of the present invention, a bored suction roll can be the press element of the second press zone.

The line force of the second press zone may be in a range of 20 kN/m to 90 kN/m.

The second press zone has a nip length in the range of 20 mm to 250 mm, or a length equal or greater than 40 mm.

In one configuration of the present invention, the opposite element of the second press zone is allocated to the belt having the lower compressibility. In an additional configuration, the press element of the second press zone is allocated to the belt having the higher compressibility. In an additional possible embodiment the opposite element of the second press zone is allocated to the opposite element of the first press zone to form the second press zone. This represents an especially cost effective solution, since the opposite element of the first press zone simultaneously serves as press element of the second press zone. One press element can therefore be eliminated. For this scenario the opposite press element of the first press zone serving as the press element of the second press zone can be equipped with suction, at least in the area of the second press zone.

The present invention further provides a method to dewater a fibrous web, especially a tissue web, whereby the fibrous web is directed through a first press zone with a press zone length $L_1$, arranged lying between a revolving permeable belt and a revolving permeable support belt, whereby a fluid flows through the belt, the fibrous web and the support belt, at least over a section of the press zone length $L_1$ and is subsequently dewatered in a second press zone having a press zone length $L_2$. The fibrous web is led through the second press zone between two belts which have different compressibilities.

According to the present invention, the fluid may first flow through the belt, then through the fibrous web and then through the support belt. In a first embodiment of the method the water in the fibrous web is drained in the first press zone through mechanical pressing power and/or displacement dewatering and/or through thermal drying. In accordance with a second embodiment of the method of the present invention, the fibrous web is dewatered in the second press zone by means of a mechanical pressing power and through the supporting effect of the belt with the higher compressibility. Due to the intimate contact of the fibrous web with the belt with the higher compressibility, capillary effects can be utilized for a better dewatering result.

The present invention further provides a machine for the production of a fibrous web especially a tissue web, including a device with a first press zone with a press zone length $L_1$ through which the fibrous web, which is arranged between a revolving permeable belt and a revolving permeable support belt, is directed. The first press zone is designed so that a fluid can flow through the belt, the fibrous web and the support belt, at least over a section of the press zone length $L_1$. In addition, the device includes a second press zone having a press zone length $L_2$ following the first press zone, as well as a third press zone consisting of a press element and a drying cylinder, for example a Yankee cylinder, through which the fibrous web is directed together with the clothing, whereby the machine includes additional devices which make it possible to realize various machinery concepts consisting of a selection and/or combination of the three press zones.

According to an additional embodiment of the present invention, the additional devices consist of a selection of at least one of the elements—guide rolls, adjustment rollers with web guides, tension rollers with tensioning devices, belt cleaning devices, and cantilever devices. The tissue machine is therefore equipped more comprehensively than would be required for the individual types and qualities. The machine frame for example, includes mounts for the additional devices, for example for the rolls, which are required only for the production of standard qualities, but not for the production of premium qualities.

The frame can also be cantilevered, which means, the frame includes a cantilever support extending transversely to the machine which, during a replacement of the clothing carries and supports the drive-side frame so that a new, seamless clothing can be installed in a short time period. This solution is advantageous especially when using a fabric with a structured surface as provided by the invention, since these fabrics are seamless because of detrimental markings. Without cantilevering, fabric replacement would be very time consuming. These additional devices therefore allow rapid modification of the machine according to the requirements for the production of tissue papers of standard quality (FIG. 4), intermediate quality (FIG. 1) and premium quality (FIG. 3) possible. A machine equipped in this manner allows the producer of tissue paper to quickly react to market changes. Products with acceptable price-quality ratios can therefore be produced.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
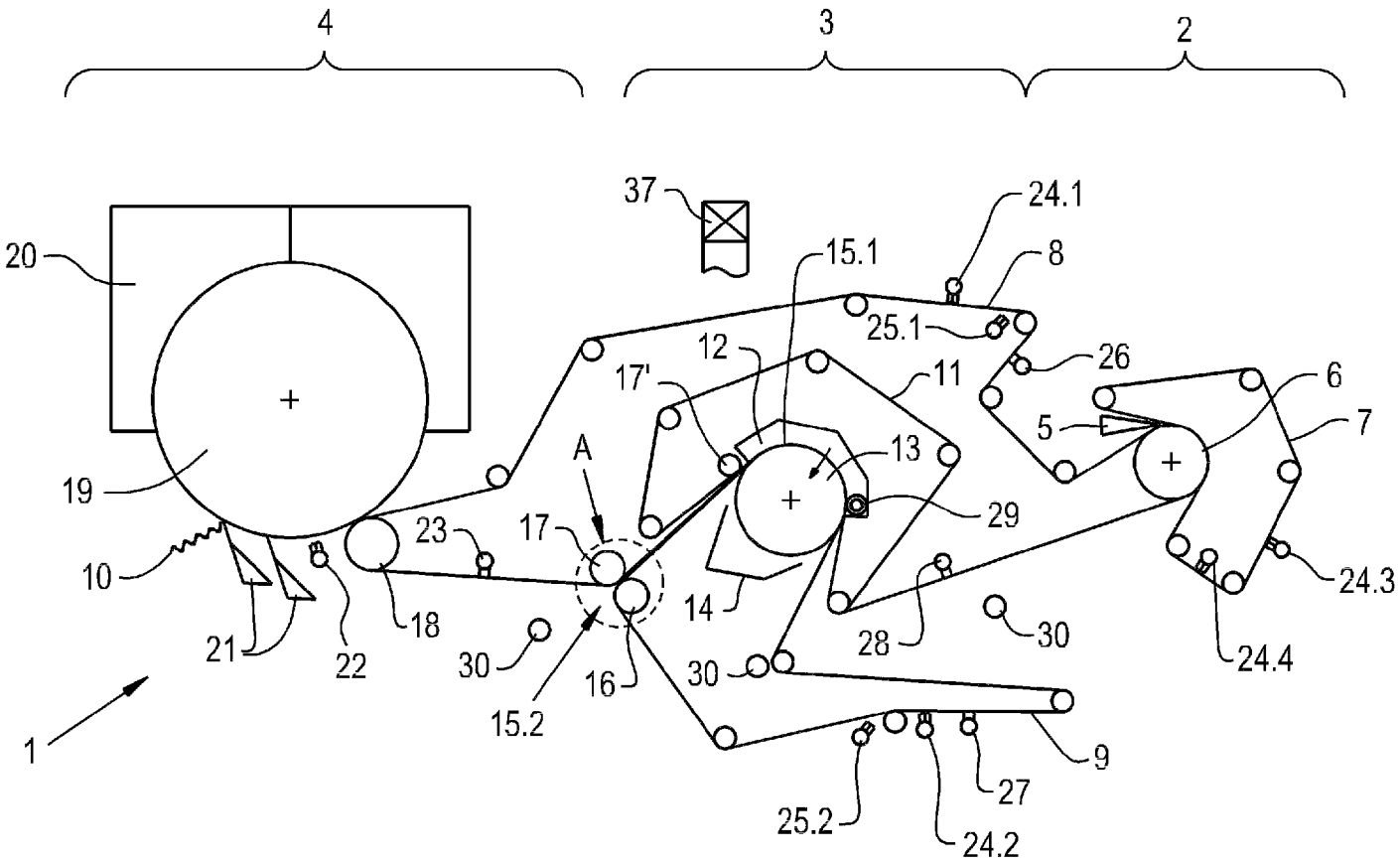
FIG. 1 illustrates a first embodiment of a tissue machine with device according to the present invention.

Referring now to the drawings, and more particularly to FIG. 1, there is shown a tissue machine for the production of tissue paper of intermediate quality and of premium quality. Machine 1 includes forming section 2, inventive device 3 and drying section 4. Tissue web 10 is formed in forming section 2. For this purpose, a fibrous stock suspension is sprayed by headbox 5 into a gap which is formed by permeable belt 8 and outer forming wire 7. Both clothings 7,8 are directed over forming roll 6 whereby the fibrous suspension is dewatered and tissue web 10 is formed. Forming roll 6 is a full jacket roll. Dewatering of fibrous web 10 occurs only through the outer wire. Permeable belt 8 is in the embodiment of a fabric with a structured surface. This has raised and indented zones, whereby the indented zones form pockets. The raised and indented zones are arranged uniformly on the fabric surface. Ornament structures can also be superimposed. During forming of fibrous web 10 in the area of forming roll 6 the pockets are filled with paper fibers of the fibrous stock suspension. This causes pillow-type voluminous zones in tissue web 10 in the areas of the pockets. Structured fabric 8 has equal or fewer than 55.7 pockets per $cm^2$ (360 pockets per $inch^2$). In this example, structured fabric 8 is a single ply, 4-strand fabric with a warp thread density of 20.9 threads per cm (53 threads/inch). The permeability is 700 cfm. The warp threads have a diameter of 0.30 mm and the weft threads have a diameter of 0.35 mm. Contact area 33 of fabric 8 with a flat surface, as for example the surface of Yankee drying cylinder 19, is 25%. Fabric 8 is endless, in other words it has no seam.

Formed tissue web 10, is transported through entire tissue machine 1 lying on fabric 8 up to the transfer to the surface of Yankee drying cylinder 19.

After forming section 2, the tissue web is directed to the first press zone of device 3 which consists of the first and a second press zone. In device 3 the tissue web is dewatered to a dry content of above 35%. First press zone 15.1 is formed by a suction roll 13 and by a permeable press element—press belt 11. Tissue web 10 is carried through first press zone 15.1 between structured fabric 8 and felt 9. The pressing pressure is generated by press belt 11 which is tensioned at 50 kN/m and amounts to approximately 71 kPa at a suction roll diameter of, for example, 1.4 m. First press zone 15.1 is designed so that a fluid, in this case heated air, can flow through tissue web 10 during the pressing procedure. Hood 12 is provided for the supply of heated air. Hood 12 includes steam shower 29 at the beginning of first press zone 15.1 for optional addition of steam. The flow direction (arrow) for the air and the steam is very important. The heated air flows first through press belt 11, then through structured fabric 8, then through tissue web 10 and after that through a permeable support belt, felt 9. The heated air with the water from tissue web 10 is sucked off by suction roll 13. The vacuum is in the range of 0.3 to 0.4 bar.

Support belt 9 is in the embodiment of a felt in accordance with Vector technology. A felt according to this technology includes a woven base fabric onto which a nonwoven so-called Vector layer consisting of coarse felt fibers is applied onto the side facing the fibrous web. The fibers of this layer are arranged three-dimensionally and have a count of more than 67 dtex. This means coarse fibers are used to produce this layer. This has the advantage that this felt layer is very open and can therefore be easily dewatered. The air permeability of this layer is in the range of 80 cfm. The air permeability of the felt is approximately 20 cfm. Moreover, the three-dimensional arrangement of the coarse fibers in the Vector layer give the felt good resilience when running through the press nip. The felt is hereby compressed and springs back after the press nip, almost to its original thickness. The Vector layer may have a base weight range of 100 g/m$^2$ to 500 g/m$^2$. The Vector layer is covered, for example, by at least one structure of laid fibers consisting of finer fibers which comes into contact with the fibrous web. Felt 9 has high resiliency characteristics. The dynamic modulus for compressibility "G" is equal or higher than 0.5 N/mm$^2$. The dynamic stiffness K* of felt 9 is less than 100000 N/mm.

Collecting tank 14 is provided at the uncovered section of suction roll 13 to remove the thrown off water.

After first press zone 15.1, dewatered tissue web 10, arranged between structured fabric 8 and felt 9, is directed for additional dewatering through second press zone 15.2. Press zone 15.2 is formed by two rolls 16, 17. Lower roll 16 which comes into contact with felt 9 is a soft, blind bored and grooved roll. The surface of the roll can have a hardness of 30 to 33 P&J. This roll consists, for example, of a roll core with a roll cover. The thickness of the roll cover is around 20 mm. The roll cover is selected so that—due to water absorption—the hardness becomes softer during operation of the roll by 4 to 5 P&J points. Lower roll 16 which comes into contact with felt 9 can also be in the embodiment of a suction press roll to increase the dewatering efficiency. In this case roll 16 is connected to a vacuum system which is not illustrated here.

Opposite element 17 of the second press zone may be in the embodiment of a smooth and/or hard roll. The surface of this roll is provided by a roll cover, whereby the thickness of the cover is approximately 15 mm. The surface has a hardness in the range of 0 to 1 P&J.

The line force of the second press zone 15.2 may be in a range of 20 kN/m to 90 kN/m. Depending on the configuration of press zone 15.2 the maximum pressing pressure is in the range between 2 to 3.5 MPa. Important influential parameters are softness of clothings 8, 9 and rolls 16, 17, 17', as well as their diameters.

The maximum pressing pressure of second press zone 15.2 is greater than the maximum pressing pressure of first press zone 15.1. An additional embodiment provides that opposite element 17' of second press zone 15.2 conspires with opposite element 13 of first press zone 15.1, thereby forming the second press zone in cooperation with opposite element 13 of the first press zone.

Beside the first and second press nip 15.2 which is formed by opposite element 17 and press element 16 an additional third press nip is provided in an additional embodiment which is formed by roll 17' and opposite element 13 of the first press zone.

After second press zone 15.2, tissue web 10 is separated from felt 9. Tissue web 10 runs together with structured fabric 8 to a third press nip which is formed by suction roll 18 and Yankee drying cylinder 19. In this press nip the fibrous web is pressed against the surface of the Yankee cylinder only in the area of the contact area (20% to 32%) of structured fabric 8. The tissue web is separated from fabric 8 and transferred to hot drying cylinder surface 19. Further drying takes place there and in the area of hot air hood 20. Finally, tissue web 10 is creped by means of scraper 21 and taken off drying cylinder surface 19. Coating applicator nozzle 22 which is already known is provided at drying cylinder 19 to apply a medium.

Tissue machine 1 includes cantilevered device 37 which makes fast replacement of clothing possible and thereby renders machine 1 for the production of another tissue quality in another machine configuration convertible.

Moreover, machine 1 includes guide rolls 30, 31, 32 (shown in FIG. 4) which are not required for the illustrated machine configuration, but are provided already for other configurations.

Figure 2:
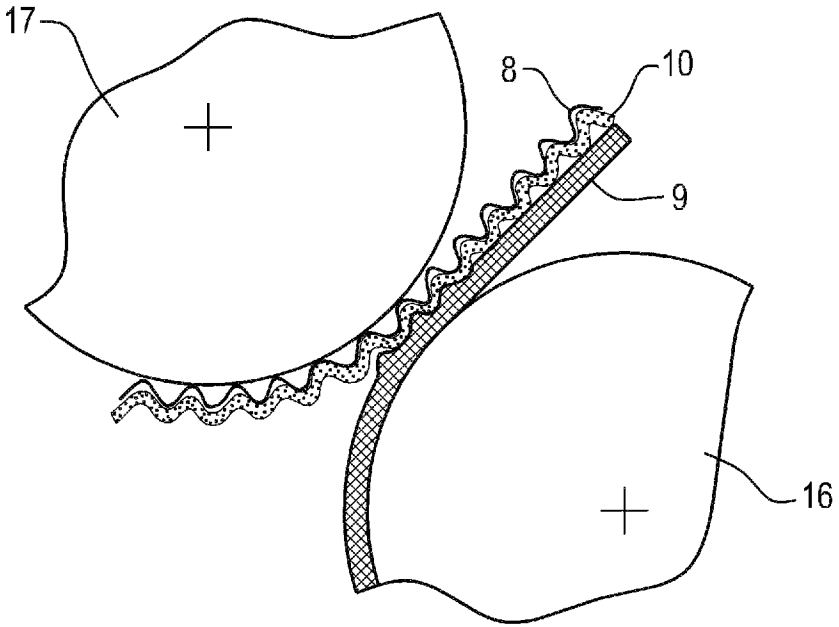
FIG. 2 is an enlarged illustration of a section of detail A of FIG. 1.

Referring now to FIG. 2, there is shown press zone 15.2 in an enlarged illustration. Felt 9 is directed away from tissue web 10 which is lying on structured fabric 8. Structured fabric 8 has a lower compressibility than felt 9.

Since felt 9 is softer than fabric 8, good contact is established—also in the area of the pockets of fabric 8—between tissue web 10 and felt 9. This favors dewatering thereby achieving a higher dry content of the tissue web.

Figure 3:
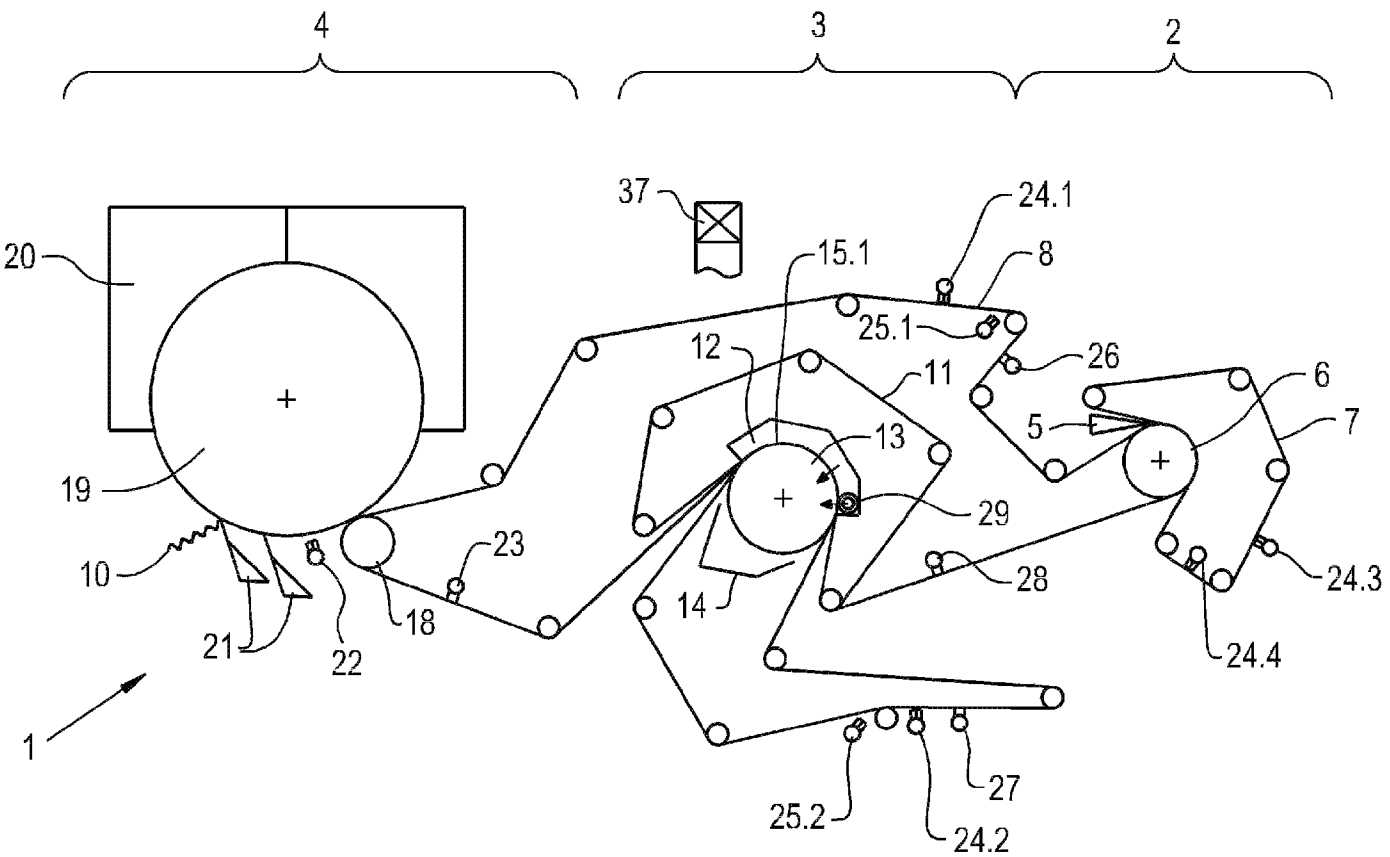
FIG. 3 illustrates a second embodiment of a tissue machine according to the present invention for the production of tissue paper of premium quality.

Referring now to FIG. 3, there is shown a machine configuration according to the present invention which is required to produce tissue webs of premium quality. The machine configuration illustrated in FIG. 1 was hereby modified through removal or opening of second press zone 15.2. The remaining machine elements and clothing are consistent with those in FIG. 1. This also applies to the component identifications.

Figure 4:
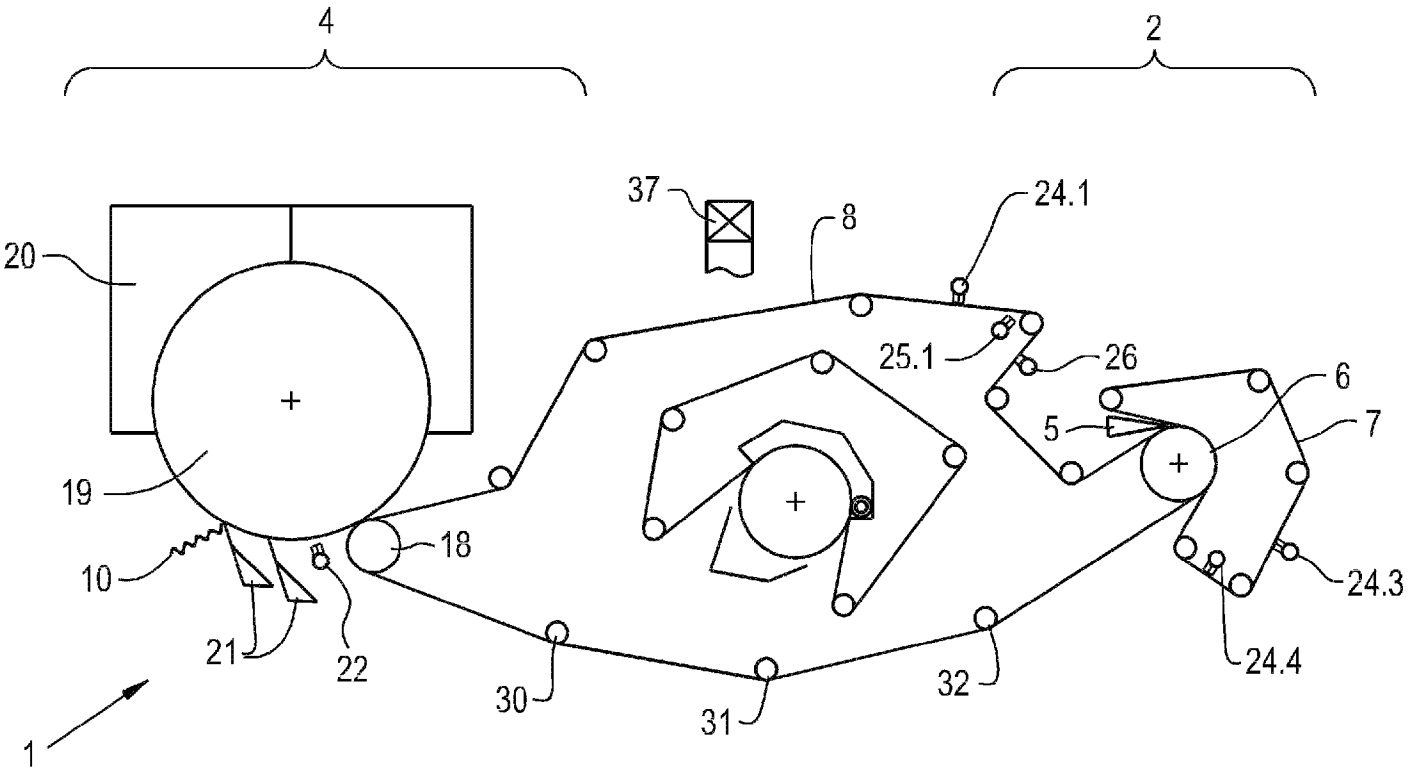
FIG. 4 illustrates a third embodiment of a tissue machine according to the present invention for the production of tissue paper of standard quality.

Referring now to FIG. 4, there is shown a machine configuration according to the present invention for the production of tissue webs of standard quality. For this, both press zones 15.1, 15.2 were removed or bypassed. Structured fabric 8 from FIG. 1 and FIG. 3 was replaced by felt 8. The only press nip is formed by suction press roll 18 and drying cylinder 19. This configuration requires the least energy, however produces tissue webs with the lowest specific volume.

Figure 5:
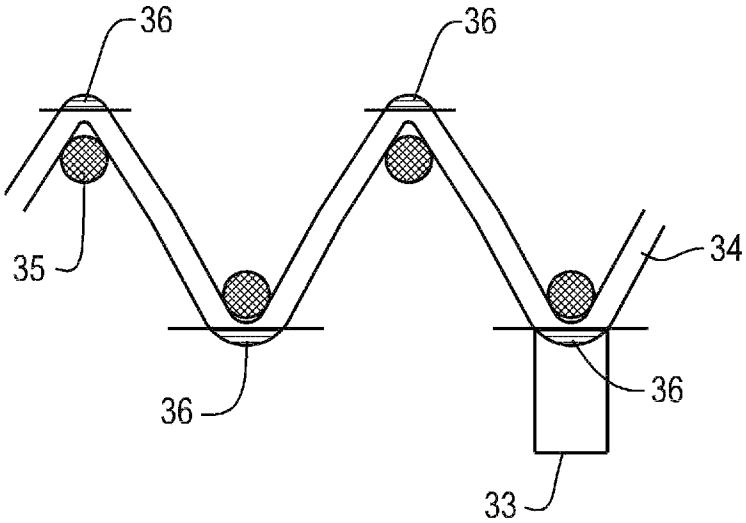
FIG. 5 is an illustration of a section of a structured fabric according to the present invention.

Referring now to FIG. 5, there is shown a schematic illustration of a structured fabric according to the present invention in which the crimps were sanded in order to enlarge the contact area. In this example, the side contacted by the paper and the opposite side are sanded. It is however appropriate if only the paper contact side is sanded.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine for the production of a fibrous web, the machine comprising:

a revolving permeable belt having a first compressibility;

a revolving permeable support belt having a second compressibility different than said first compressibility;

a first press zone defined between said revolving permeable belt and said revolving permeable support belt, said first press zone having a first press zone length and configured so that a fluid can flow through said revolving permeable belt, the fibrous web and said revolving permeable support belt in at least a section of said first press zone length, the fibrous web being directed through said first press zone and arranged lying between said revolving permeable belt and said revolving permeable support belt; and a second press zone following said first press zone, said second press zone defined between said revolving permeable belt and said revolving permeable support belt and having a second press zone length, the fibrous web being carried through said second press zone between said revolving permeable belt and said revolving permeable support belt.

a press element and a drying cylinder defining a third press zone through which the fibrous web is directed together with a clothing; and a plurality of devices for defining at least one of a selection and a combination of said first press zone, said second press zone and said third press zone.

2. The machine according to claim 1, wherein said drying cylinder is a Yankee cylinder.

3. The machine according to claim 2, wherein said plurality of devices each include at least one of a plurality of elements including a plurality of guide rolls, adjustment rollers with web guides, tension rollers with tensioning devices, belt cleaning devices and cantilever devices.

4. The machine according to claim 1, wherein the fibrous web is a tissue web.

5. The machine according to claim 1, wherein said revolving permeable support belt has a higher compressibility and is a felt.

6. The machine according to claim 5, wherein said felt includes a woven base fabric and a layer of non-woven felt fibers applied on a web-side surface of said base fabric.

7. The machine according to claim 6, wherein said felt fibers are aligned three dimensionally and have a count of greater than 30 decitex (dtex).

8. The machine according to claim 7, wherein said count is greater than 67 dtex.

9. The machine according to claim 8, wherein said count is greater than 100 dtex.

10. The machine according to claim 9, wherein said count is greater than 140 dtex.

11. The machine according to claim 1, further comprising a frame including a cantilever support extending transversely to the machine, said cantilever support being configured to carry and support a drive-side frame of the machine.

* * * * *

UNITED STATES PATENT AND TRADEMARK OFFICE

CERTIFICATE OF CORRECTION

PATENT NO. : 8,580,083 B2
APPLICATION NO. : 13/749182
DATED : November 12, 2013
INVENTOR(S) : Joao V. Boechat et al.

It is certified that error appears in the above-identified patent and that said Letters Patent is hereby corrected as shown below:

In the Specification

COLUMN 1

Line 8, delete "noq", and substitute therefore --now--.

Signed and Sealed this
Thirtieth Day of December, 2014

Michelle K. Lee

Michelle K. Lee
*Deputy Director of the United States Patent and Trademark Office*